US008631877B2

(12) United States Patent
Gewily

(10) Patent No.: US 8,631,877 B2
(45) Date of Patent: Jan. 21, 2014

(54) APPARATUS AND METHODS FOR INFLOW CONTROL

(75) Inventor: Ahmed Amr Gewily, Al-Khobar (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 118 days.

(21) Appl. No.: 12/478,503

(22) Filed: Jun. 4, 2009

(65) Prior Publication Data

US 2009/0301730 A1 Dec. 10, 2009

Related U.S. Application Data

(60) Provisional application No. 61/059,391, filed on Jun. 6, 2008.

(51) Int. Cl.
*E21B 43/00* (2006.01)

(52) U.S. Cl.
USPC ..... 166/387; 166/313; 166/377; 166/191

(58) Field of Classification Search
USPC ..... 166/313, 50, 387, 127, 147, 191, 305.1, 166/51, 377
See application file for complete search history.

(56) References Cited

U.S. PATENT DOCUMENTS

| | | | | |
|---|---|---|---|---|
| 2,824,612 | A * | 2/1958 | Lynes | 166/147 |
| 2,831,541 | A * | 4/1958 | Conover | 166/147 |
| 5,220,959 | A * | 6/1993 | Vance, Sr. | 166/187 |
| 5,517,854 | A | 5/1996 | Plumb et al. | |
| 5,921,318 | A * | 7/1999 | Ross | 166/250.17 |
| 6,059,033 | A * | 5/2000 | Ross et al. | 166/278 |
| 6,497,284 | B2 * | 12/2002 | van Petegem et al. | 166/297 |
| 7,096,954 | B2 | 8/2006 | Weng et al. | |
| 7,267,172 | B2 | 9/2007 | Hofman | |
| 7,281,592 | B2 | 10/2007 | Runia et al. | |
| 7,419,002 | B2 * | 9/2008 | Dybevik et al. | 166/205 |
| 7,637,320 | B2 | 12/2009 | Howard et al. | |
| 7,717,183 | B2 * | 5/2010 | Ezell et al. | 166/373 |
| 2001/0018977 | A1 * | 9/2001 | Kilgore | 166/387 |
| 2003/0047311 | A1 * | 3/2003 | Echols et al. | 166/278 |
| 2007/0051507 | A1 * | 3/2007 | Ross et al. | 166/51 |
| 2008/0006413 | A1 | 1/2008 | Le Gloahec et al. | |
| 2008/0023205 | A1 * | 1/2008 | Craster et al. | 166/387 |
| 2009/0301730 | A1 | 12/2009 | Gweily | |

OTHER PUBLICATIONS

About. (n.d.). Dictionary.com Unabridged. Retrieved Dec. 15, 2011, from Dictionary.com website: http://dictionary.reference.com/browse/about.*

* cited by examiner

*Primary Examiner* — Jennifer H Gay
*Assistant Examiner* — Robert E Fuller
(74) *Attorney, Agent, or Firm* — Jeffery R. Peterson; Brandon Clark

(57) ABSTRACT

A first tubular member disposed within a second tubular member, and an annulus formed therebetween. The second tubular member can have a first and second packer disposed about an outer diameter thereof. The first packer can have a slip. The packers can be in fluid communication with the inner diameter of the first tubular member via one or more flow ports formed through the first tubular member. One or more inflow control devices can be disposed between the packers.

16 Claims, 4 Drawing Sheets

APPARATUS AND METHODS FOR INFLOW CONTROL

CROSS-REFERENCE TO RELATED APPLICATIONS

This application claims priority to U.S. Provisional Patent Application having Ser. No. 61/059,391, filed on Jun. 6, 2008, which is incorporated by reference herein.

BACKGROUND

A wellbore can pass through various hydrocarbon bearing reservoirs or extend through a single reservoir for a relatively long distance. A technique to increase the production of the well is to perforate the well in a number of different hydrocarbon bearing zones. However, an issue associated with producing from a well in multiple hydrocarbon bearing zones is controlling fluid flow from the wellbore into a completion assembly. For example, in a well producing from a number of separate hydrocarbon bearing zones, one hydrocarbon bearing zone can have a higher pressure than another hydrocarbon bearing zone. Without proper management, the higher pressure hydrocarbon bearing zone produces into the lower pressure hydrocarbon bearing zone rather than to the surface.

Similarly, in a situation unique to horizontal wells, hydrocarbon bearing zones near the "heel" of the well (closest to the vertical or near vertical part of the well) may begin to produce unwanted water or gas (referred to as water or gas coning) before those zones near the "toe" of the well (furthest away from the vertical or near vertical departure point) begin producing unwanted water or gas. Production of unwanted water or gas in any one of these hydrocarbon bearing zones may require special interventions to stop production of the unwanted water or gas.

Inflow control devices have been used to manage pressure differences between different zones in both horizontal and vertical wellbores. Inflow control devices are often located within the wellbore and anchored to a casing hanger or production cased hole packer. In some circumstances, it may be desirable to locate the inflow control devices adjacent certain sections or fractures within the wellbore. The selective location of the inflow control devices adjacent only certain segments of the wellbore is problematic because the release of a running tool from the inflow control device or completion can cause wear and tear on the packers securing the inflow control device or the completion. The wear and tear to the packers securing the inflow control device or completion can cause the packers to lose integrity. Consequently, leaks can form in the packers or the seals between the packers and the wellbore. If leaks form, the efficacy of the inflow control devices or completions can be compromised.

There is a need, therefore, for an inflow control device that can be selectively located within a portion of a wellbore without damaging the packers of the inflow completion assembly.

SUMMARY

Apparatus and methods for straddling a completion are provided. In at least one specific embodiment, the apparatus can include a first tubular member disposed within a second tubular member so that an annulus is formed therebetween. A first packer and second packer can be disposed about an outer diameter of the second tubular member. The first packer can comprise a slip. A first flow port can be formed through the first tubular member to provide fluid communication between an inner diameter of the first tubular member and the first packer. A portion of the annulus adjacent the first flow port can be isolated from other portions of the annulus. A second flow port can also be formed through the first tubular member to provide fluid communication between the inner diameter of the first tubular member and the second packer. A portion of the annulus adjacent the second flow port can be isolated from other portions of the annulus. An inflow control device can be disposed between the first packer and the second packer. The apparatus can further include a flow control device secured to a terminal end of the first tubular member adjacent the second packer. The flow control device can be selectively engaged to build pressure within the inner diameter of the first tubular member.

The apparatus can be located within a wellbore, and the packers can be set. The first tubular member can be released from the second tubular member. The force generated during the removal of the first tubular member from the second tubular member can be transferred to wellbore through the first packer.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
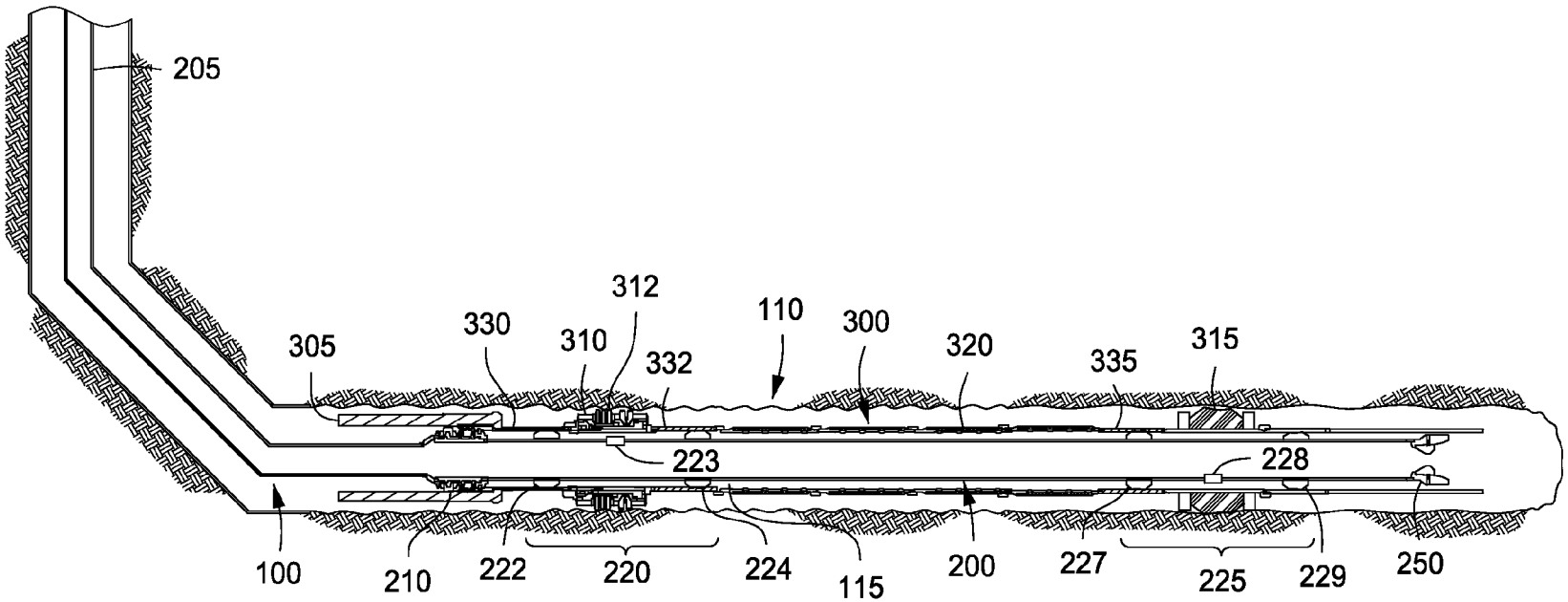
FIG. 1 depicts a schematic view of an illustrative inflow completion assembly disposed within a wellbore, according to one or more embodiments described.

FIG. 1 depicts a schematic view of an illustrative inflow completion assembly 100 disposed within a wellbore 110, according to one or more embodiments. The inflow completion assembly 100 can include one or more first tubular members 200 disposed within one or more second tubular members 300 so that an annulus 115 is formed therebetween. The first tubular member 200 can be used to run the second tubular member 300 into the wellbore 110, and can also be used to set the second tubular member 300 within the wellbore 110. The second tubular member 300 can have one or more "upper" or first packers 310 and one or more "lower" or second packers 315 disposed about an outer diameter thereof. The first packer 310 can have one or more slips 312. The slips 312 can be used to transfer force applied to the inflow completion assembly 100 to the wellbore 110. For example, if a rotational or axial force is applied to the inflow completion assembly 110 the slips 312 can transfer force to the wall of the wellbore 110.

The first tubular member 200 can include one or more flow ports (two are shown 223, 228) formed through at least a portion thereof. The flow ports 223, 228 can be formed through the first tubular member 200 in any radial and/or longitudinal pattern. Any number of flow ports can be used, such as two, three or two to five, although two or more are preferred. In one or more embodiments, the flow ports 223, 228 can be located about the tubular member 200 such that the "upper" or first flow port 223 can be in fluid communication with the first packer 310 and the "lower" or second flow port 228 can be in fluid communication with second packer 315. For example, when the first tubular member 200 is operatively connected to the second tubular member 300, the first flow port 223 and the second flow port 228 can be in fluid communication with the inner diameter of the first tubular member 200 and the annulus 115. The sealing members 222, 224 can isolate a portion of the annulus 115 adjacent the first flow port 223 from other portions of the annulus 115, and the pressure within the inner tubular member 200 can be used to actuate the first packer 310. The sealing members 227, 229 can isolate a portion of the annulus 115 adjacent the second flow port 228 from the other portions of the annulus 115, and the second flow port 228 can be used to actuate the second packer 315.

The flow ports 223, 228 can be holes formed through the first tubular member 200. The flow ports 223, 228 can include one or more through holes arranged about the first tubular member 200 in any pattern. Furthermore, the flow ports 223, 228 can have any cross section. For example, the cross section of the flow ports 223, 228 can be circular, rectangular, triangular, or another shape. The flow ports 223, 228 can allow fluid communication between the inner diameter of first tubular member 200 and the annulus 115. In one or more embodiments, each flow port 223, 228 can include one or more relief valves, rupture disks, or other pressure relief devices disposed therein for selectively controlling the flow of pressure or fluid through the flow ports 223, 228. For example, the flow ports 223, 228 can each have a pressure relief valve that can prevent fluid flow through the ports 223, 228 until a pre-determined pressure is reached within the first tubular member 200. The pre-determined pressure can be the pressure necessary to set the packers 310, 315. Accordingly, after the pre-determined pressure is achieved within the first tubular member 200, the pressure relief valve can allow the pressurized fluid and/or air to flow through the flow ports 223, 228 and actuate the packers 310, 315.

The sealing members 222, 224, 227, 229 can be any downhole sealing device. For example, the sealing members 222, 224, 227, 229 can be or include at least one or more O-ring seals, D-seals, T-seals, V-seals, X-seals, flat seals, lip seals, or swap cups. The sealing members 222, 224, 227, 229 can be made from or include one or more materials, including but not limited to, nitrile butadiene (NBR), carboxylated acrylonitrile butadiene (XNBR), hydrogenated acrylonitrile butadiene (HNBR) which is commonly referred to as highly saturated nitrile (HSN), carboxylated hydrogenated acrylonitrile butadiene (XHNBR), hydrogenated carboxylated acrylonitrile butadiene (HXNBR), ethylene propylene rubber (EPR), ethylene propylene diene rubber (EPDM), tetrafluoroethylene propylene (FEPM), fluoroelastomer rubbers (FKM), perfluoroelastomer (FEKM), and the like. The seal members 222, 224, 227, 229 can also be made from or include one or more thermoplastics such as polphenylene sulfide (PPS), polyetheretherketones such as (PEEK), (PEK) and (PEKK), polytetrafluoroethylene (PTFE), and the like.

Figure 2:
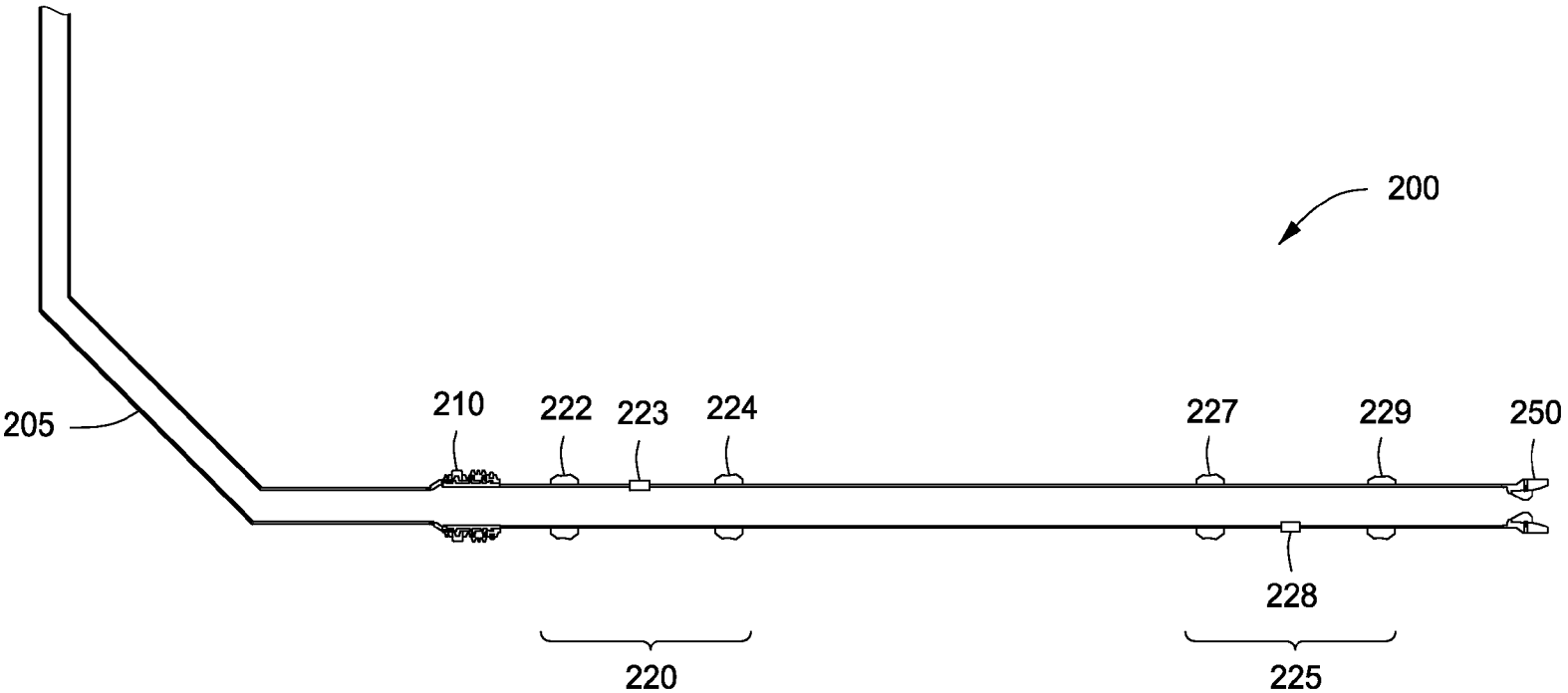
FIG. 2 depicts a cross sectional view of an illustrative first tubular member, according to one or more embodiments described.

Considering the first tubular member 200 in more detail, FIG. 2 depicts a cross sectional view of the first tubular member 200, according to one or more embodiments. The first tubular member 200 can be two or more segments or sections of tubulars connected together. The first tubular member 200 can include a single section, two or more sections, three or more sections, four or more sections, twenty or more sections, thirty or more sections, or any number of sections required to properly locate the inflow completion assembly at a desired depth or location within the wellbore 110. In at least one specific embodiment, a first section can be a setting and/or running tool 210, a second section can be a first actuation assembly 220 and can include the first flow port 223 and one or more sealing members 222, 224, a third section can be a second actuation assembly 225 and can include the second flow port 228 and one or more sealing components 227, 229, and a fourth section can include the flow control device 250. One or more additional sections can be disposed between one or more sections of the first tubular member 200. For example, blank pipe can be disposed between the second section and the third section. The setting tool 210, the first flow port 223, the second flow port 228, and the flow control device 250 can be integrated together as one or more sections of the first tubular member 200. As such, the setting tool 210, the first flow port 223, the second flow port 228, and the flow control device 250 can be selectively combined to form one or more sections of the first tubular member 200. For example, a first section can include the setting tool 210, the first flow port 223, and the second flow port 228 and a second section can include the flow control device 250.

The setting tool 210 can have one or more collets or latching members (not shown) that can releasably engage a portion of the second tubular member 300. For example, the setting tool 210 can have a latch that can selectively connect to a collar (not shown) disposed about an inner diameter of the second tubular member 300. In one or more alternative embodiments, a portion of the second tubular member 300 can have a collar disposed about an inner diameter thereof, and the collar can be configured to receive a collet (not shown) disposed about a portion of the setting tool 210. As such, the setting tool 210 can be used to secure with one or more mechanisms disposed about the second tubular member 300 and secure the tubular members 200, 300 together. Additionally, the setting tool 210 can be connected to a drill pipe 205. The drill pipe 205 can convey the setting tool 210 into the wellbore 110. As the drill pipe 205 conveys the setting tool 210 into the wellbore 110, the setting tool 210 can run the second tubular member into the wellbore 110. The drill pipe 205 can also remove the first tubular member 200 from the wellbore 110, and/or provide fluid communication between the surface and the inner diameter of the first tubular member 200. For example, the drill pipe 205 can provide fluid communication between the surface and the inner diameter of the first tubular member 200, and can provide pressurized fluid to set one or more packer 310, 315 and/or release the setting tool 210 from the second tubular member 300. When the setting tool 210 is released from the second tubular member 300, the drill pipe 205 can be used to retrieve the setting tool 210 to the surface.

A flow control device 250 can be disposed at an end of the first tubular member 200. For example, the flow control device 250 can be integrated with and/or otherwise part of the first tubular member 200. When the first tubular member 200 is operatively connected to the second tubular member 300, the flow control device 250 can be adjacent or proximate the second packer 315. The flow control device 250 can be selectively engaged to build pressure within the inner diameter of the first tubular member 200. The pressure within the inner diameter of the first tubular member 200 can be used to actuate any one or more of the packers 310, 315 and/or release the second tubular member 300 from the first tubular member 200.

The flow control device 250 can be a valve or other device capable of preventing fluid flow through a terminal end of the first tubular member 200. The flow control device 250 can be a ball valve, an electrically operated valve, a go/no-go valve, a diaphragm valve, a needle valve, a globe valve, or another valve. The flow control device 250 can be configured to be remotely actuated. For example, the flow control device 250 can be actuated hydraulically, electrically, or mechanically. For example, the flow control device 250 can be in communication with the surface and one or more signals can be sent from the surface to the flow control device 250, and the signals can instruct the flow control device 250 to close and/or open. In one or more embodiments, the flow control device 250 can be a go/no-go valve and can catch a trigger, such as a dart, a ball, or another device, sent through the inner diameter of the first tubular member 200 when the trigger has an outer diameter larger than the inner diameter of the valve, and the trigger can block fluid flow through the valve.

In at least one specific embodiment, the flow control device 250 can be configured to catch one or more triggers (not shown in FIG. 2) sent through the first tubular member 200. The triggers can be a dart, a ball, a plug, or the like, and the triggers can either be permanent or dissolvable. The flow control device 250 can be releasably secured to the first tubular member 200. For example, a shearable member (not shown), such as a shear pin or screw, can secure the flow control device 250 to the first tubular member 200, and the shearable member can be designed to break after a pre-determined pressure is applied to the inner diameter of the first tubular member 200. The pre-determined pressure can be greater than the pressure required to actuate the packers 310, 315. When the shearable member is broken, the flow control device 250 can be released from the first tubular member 200, and the flow control device 250 and the trigger can flow into the wellbore 110. In one or more embodiments, the flow control device 250 can be reopened by applying pressure to the inner diameter of the first tubular member 200 and forcing the trigger engaged with the flow control device 250 to deform and pass through the flow control device 250. The trigger can be designed to deform at a pressure greater than that required to set the packers 310, 315.

Figure 3:
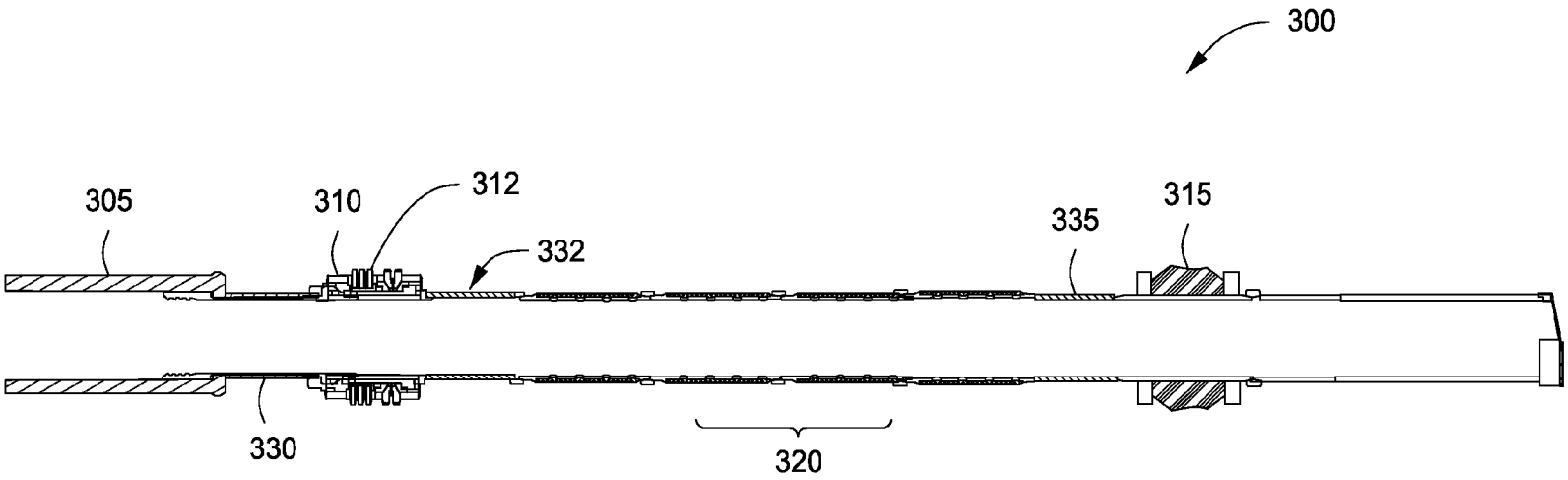
FIG. 3 depicts a cross sectional view of an illustrative second tubular member, according to one or more embodiments described.

FIG. 3 depicts a cross sectional view of an illustrative second tubular member 300, according to one or more embodiments. Referring to FIGS. 1 and 3, the second tubular member 300 can include two or more segments or sections of pipe or tubulars connected together. The second tubular member 300 can include a first section having a setting sleeve 305 integrated therewith, a second section having the first packer 310 integrated therewith, a third section having one or more inflow control devices 320 integrated therewith, and a fourth section having a second packer 315 integrated therewith.

In one or more embodiments, the setting sleeve 305, the first packer 310, the inflow control devices 320, and the second packer 315 can be arranged and combined about or with one or more sections of the second tubular member 300. For example, the second tubular member can have a first section that has the first packer 310 and the setting sleeve 305 integrated therewith, a second section having the inflow control device 320 integrated therewith, and a third section having the second packer 315 integrated therewith. Other combinations are possible. For example, the setting sleeve 305, the packers 310, 315, and the inflow control devices 320 can be integrated together as a single tubular section. In addition, one or more blank pipes or spacer pipes can be disposed between one or more of the sections of the second tubular member 300. For example, a blank pipe 330 can be disposed between the setting sleeve 305 and the first packer 310, and a blank pipe 335 can be disposed between the inflow control devices 320 and the second packer 315.

The packers 310, 315 can be disposed about the second tubular member 300. Accordingly, the packers 310, 315 can be disposed about the second tubular member 300 by disposing the packers 310, 315 about one or more sections forming the second tubular member 300. The packers 310, 315 can secure the second tubular member 300 within the wellbore 110 and isolate one or more portions of the wellbore 110 from one another. The packers 310, 315 can be selectively arranged about the second tubular member 300. For example, the packers 310, 315 can be disposed about the second tubular member 300 such that the packers 310, 315 can isolate a target portion of the wellbore 110. Illustrative packers 310, 315 can include compression or cup packers, inflatable packers, "control line bypass" packers, polished bore retrievable packers, other downhole packers, or combinations thereof. In addition, the first packer 310 can include one or more of the slips 312 movable integrated or connected therewith. For example, the packer 310 can include one or more slips 312 disposed about a mandrel or body (not shown). The mandrel can have one or more shoulders (not shown), which can be configured to control the travel of the slips 312 about the mandrel. The slips 312 can be one or more components that are circumferentially arranged about the exterior surface of the mandrel and held together as an annular assembly by an expandable ring or other suitable device (not shown).

The setting sleeve 305 can be configured to releasably connect to the setting tool 210 and/or the first packer 310. For example, the setting sleeve 305 can have a first end that is configured to receive the setting tool 210 so that at least a portion of the first end of the setting sleeve 305 can latch to the setting tool 210. The setting tool 210 can be released from the setting sleeve 305 by building pressure within the first tubular member 200. In another embodiment, the setting tool 210 can be configured to be released from the setting sleeve 305 by rotation. For example, a portion of the setting sleeve 305 can have a collet (not shown) threadably connected thereto. The collet can latch to the setting tool 210 to connect the tubular members 200, 300 together. When the setting tool 210 is engaged with the collet, the setting tool 210 can be rotated to release the collet from the setting sleeve 305. Accordingly, when the collet is released from the second setting sleeve 305, the first tubular member 200 is free to move from the second tubular member 200. The setting sleeve 305 can be connected with the first packer 310. For example, the setting sleeve 305 can have a second end connected to the first packer 310 by one or more blank pipes 330. The setting sleeve 305 can be connected to the first packer 310 such that any force transmitted to or experienced by the setting sleeve 305 is transferred to the wellbore 110 by the first packer 310. For example, the setting sleeve 305 can be connected to the first packer 310 such that the slips 312 can transfer any force experienced by the second tubular member 300 to the wellbore 110.

The inflow control devices 320 can be disposed between the packers 310, 315 and/or connected to the packers 310, 315. The second tubular member 300 can include one, two, three, four, or more inflow control devices 320. The inflow control devices 320 can be or include any downhole device capable of causing a pressure drop therethrough. For example, the inflow control devices 320 can be a nozzle, an orifice, an aperture having one or more tortuous flow paths formed therethrough, a tube have a varying or reduced diameter, and/or an aperture having a spiral flow path formed therethrough. In one or more embodiments, multiple inflow control devices 320 can be connected together in series between the packers 310, 315 and each inflow control device can provide a different pressure drop therethrough. For example, the inflow control devices 320 can include a first inflow control device connected to a second inflow control device, and the first inflow control device can provide a larger pressure drop therethrough than the second inflow control device. In one or more embodiments, at least one of the inflow control device 320 can provide a varying pressure drop therethrough. For example, the inner diameter of the inflow control device 320 can have an adjustable inner diameter, which can be adjusted to increases and/or decreases the flow area and/or pressure drop therethrough.

In one or more embodiments, the inflow control devices 320 can include one or more flow restrictors (not shown), which can be integrated with the second tubular member 300 immediately prior to conveyance of the second tubular member 300 into the wellbore 110 and/or at some other time. When the well conditions and desired production parameters are known, the flow restrictor can be configured to have an appropriate inner diameter, length, and other characteristics to produce a desired flow restriction or pressure drop therethrough. The inflow control devices 320 can include one or more flow restrictors. Furthermore, when the second tubular member 300 includes more than one inflow control device 320, each individual inflow control device 320 can be configured to provide a different pressure drop therethrough. The pressure drop caused by the inflow control devices 320 can be adjusted by changing the number of flow restrictors disposed in the inflow control devices 320, the flow area of the flow restrictors, and/or the length of the flow restrictors. For example, if the second tubular member 300 includes two inflow control devices 320, one of the inflow control devices 320 can have ten flow restrictors and the second inflow control device 320 can have one flow restrictor. When the inflow control device 320 has more than one flow restrictor, the flow restrictors can be connected together in series. The flow restrictors can be elongated tubes and can be configured to require fluid flowing therethrough to change directions one or more times. When the fluid changes directions, a pressure drop or velocity change is imparted to the flowing fluid, and the flow of the fluid through the inflow control devices can be controlled.

The inflow control devices 320 can be used to control the production of hydrocarbons from a wellbore and/or hydrocarbon producing zone to the surface. In addition, the inflow control devices 320 can be used to control the flow of one or more fluids flowing from the second tubular member 300 to the wellbore 110 and/or hydrocarbon bearing zone. The fluid can be or include any fluid delivered to a formation to stimulate production including, but not limited to, fracing fluid, acid, gel, foam or other stimulating fluid. The fluid can be injected into the wellbore 110 to provide an acid treatment, a clean up treatment, and/or a work over treatment to the wellbore 110 and/or hydrocarbon producing zone.

The inflow control devices 320 can be connected or secured in series about the second tubular member 300 or integrated within the second tubular member 300, and a "left" or first portion of one or more of the inflow control devices 320 can be connected or secured to the first packer 310. Accordingly, the first packer 310 can support the connected inflow control devices 320. A "right" or second portion of one or more of the inflow control devices 320 can connect or secure to the second packer 315.

In one or more embodiments, a blank pipe 332 can be disposed between the first packer 310 and the inflow control devices 320, and the blank pipe 332 can be used to connect or secure the first portion of one or more of the inflow control devices 320 to the first packer 310. Furthermore, the blank pipe 335 can connect the second portion of one or more inflow control devices 320 with the first end of the second packer 315. The blank pipes 330, 332, 335 can be any length that is sufficient for the packers 310, 315, when set, to isolate a target hydrocarbon bearing zone. The length of the blank pipe 330, 332, 335 and/or the second tubular member 300, for example, can be determined by logging information, wellbore data, reservoir data, and/or other data that can provide the length or at least an approximation of the length of the reservoir, hydrocarbon producing zone, and/or wellbore portion to be isolated and straddled by the inflow completion assembly 100.

Figure 4:
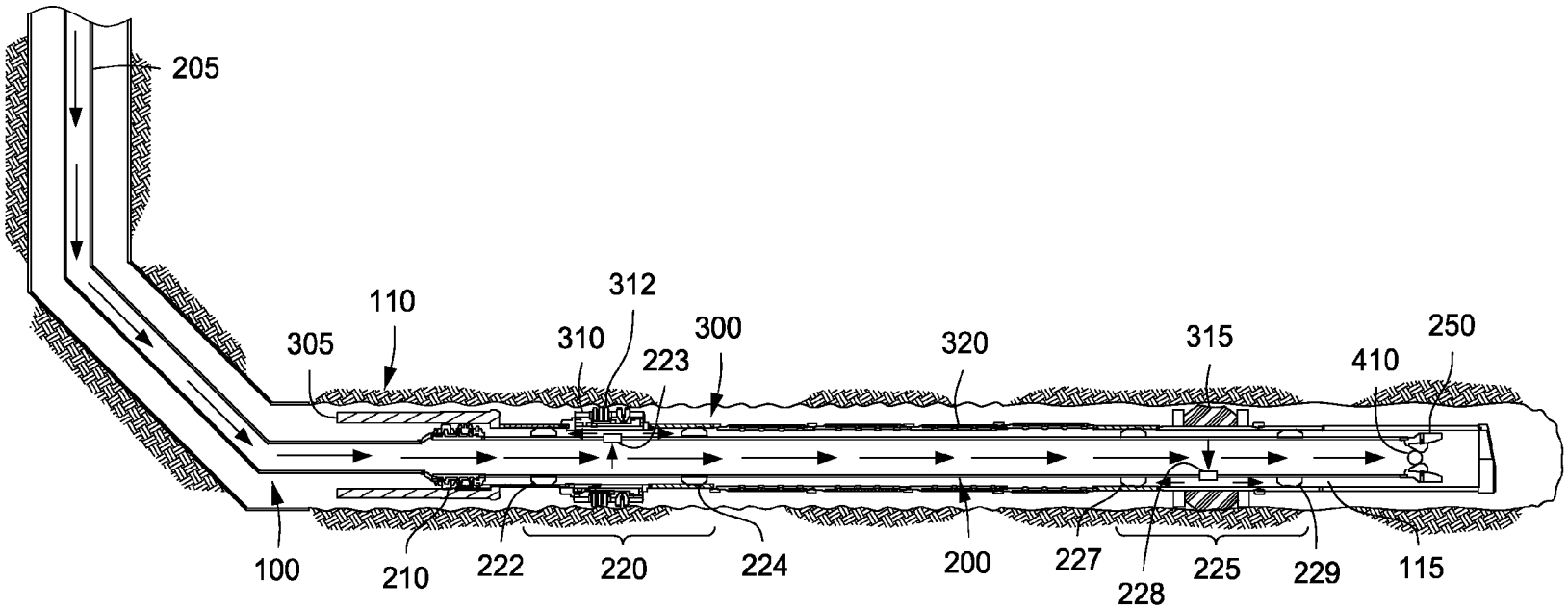
FIG. 4 depicts a schematic view of the inflow completion assembly of FIG. 1 actuated within the wellbore, according to one or more embodiments described.

FIG. 4 depicts a schematic view of the inflow completion assembly of FIG. 1 actuated within the wellbore, according to one or more embodiments. In operation, the first tubular member 200 and the second tubular member 300 can be connected together at the surface or top of the wellbore 110. After the first tubular member 200 and the second tubular member 300 are connected together, drill pipe 205 connected to the setting tool 210 can be used to convey the completion assembly 100 into the wellbore 110. When the completion assembly 100 is conveyed to the desired location within the wellbore 110, the completion assembly 100 can be actuated. The completion assembly 100 can be actuated by dropping or sending a trigger 410 into the first tubular member 200 until the trigger 410 engages or catches the flow control device 250. When the trigger 410 is engaged with the flow control device 250, pressure can build within the first tubular member 200. The pressure within the first tubular member 200 can be communicated to the annulus 115 through the actuation assemblies 220, 225. Accordingly, the pressure communicated to the annulus 115 through the first flow port 223 is isolated from the wellbore 110 by the sealing members 222, 224, and the pressure communicated to the annulus 115 through the second flow port 228 is isolated from the wellbore 110 by sealing members 227, 229. Accordingly, the pressure passing through the flow ports 223, 228 can actuate the packers 310, 315.

Once the packers 310, 315 are set, the pressure within the first tubular member 200 can build to a second pressure, such as 3,000 psi or more, 3,500 psi or more, or 4,000 psi or more. The second pressure causes the setting sleeve 305 to release the setting tool 210. For example, the pressure can actuate one or more latches securing the setting tool 210 to the setting sleeve 305. The setting tool 210 can still be engaged or in contact with at least a portion of the setting sleeve 305 after the latch is released. Accordingly, to remove the setting tool 210 from the setting sleeve 305, a removal force can be applied to the setting tool 210. The removal force can be large or significant if large portions of the setting sleeve 305 and setting tool 210 are still in contact with one another. The setting tool 210 can transfer the removal force to any portion of the setting sleeve 305 that is in contact with the setting tool 210. As such, the removal force can urge the setting sleeve 305 towards the surface. The removal force that is urging the setting sleeve 305 towards the surface can be offset or countered by an equal and opposite counter force applied to the setting sleeve 305 by the first packer 310. Accordingly, the counter force can be equivalent to the removal force. Since the counter force is equal to the removal force, the setting sleeve 305 can be placed in a static condition, and the setting tool 210 can move relative to the setting sleeve 305. As the setting tool 210 moves relative to the setting sleeve 305, the setting tool 210 and first tubular member 200 can be retrieved to the surface. Furthermore, the first packer 310 can isolate the rest of the second tubular member 300 from the counter force and/or removal force by transferring the counter force to the wellbore 110. The first packer 310 can transfer the counter and/or removal force to the wellbore 110 through the slips 312 engaged with the wellbore 110. Accordingly, the removal force does not damage the packers 310, 315.

As mentioned above, the setting tool 210 can be released from the setting sleeve 305 by rotation. The rotation can be applied to the setting tool 210 through the drill pipe 205. The rotation applied to the setting tool 210 can be transferred to the setting sleeve 305. The packer 310 can keep the setting sleeve 305 in a static state by applying an equal and opposite counter force to the rotation force applied to the setting tool 210. The first packer 310 can isolate the rest of the second tubular member 300 from the rotational force and/or counter force by transferring the rotational force and/or counter force to the wellbore 110. In one or more embodiments, the first packer 310 can transfer the rotational force and/or counter force to the wellbore 110 via slips 312.

When the first tubular member 200 is removed from the second tubular member 300, the second tubular member 300 can be used to produce hydrocarbons from, inject fluids into, provide treatment to, and/or otherwise work over the wellbore 110. For example, when hydrocarbons are being produce from the wellbore, the inflow control devices 320 can control the hydrocarbon flow rate from the target hydrocarbon bearing zone and the second tubular member 300 can provide fluid communication between the surface and the target hydrocarbon bearing zone. When fluid is injected into the wellbore 110, the inflow control devices 320 can control the flow rate of the fluids into the 110 and the second tubular member 300 can provide fluid communication between the target hydrocarbon bearing zone and/or wellbore 110 and the surface. Similarly, the second tubular member 300 can provide fluid communication between the surface and the target hydrocarbon bearing zone and/or the wellbore 110, and the inflow control devices 320 can control the flow rate of fluids flowing into the wellbore 110 and/or target hydrocarbon bearing zone. In one or more embodiments, a portion of the second tubular member 300 extending past the second packer 315 into a second portion of the wellbore 110 can be used to produce hydrocarbons from the second portion of the wellbore 110 to the surface. For example, the portion of the second tubular member 300 extending past the second packer 315 into the second portion of the wellbore 110 can connect with a completion previously installed (not shown) within the wellbore 110. In addition, another completion (not shown) can be run into the wellbore 110 and can be placed in fluid communication with the second tubular member 300 allowing for the production of hydrocarbons from the first portion of the wellbore 110 to the surface.

Certain embodiments and features have been described using a set of numerical upper limits and a set of numerical lower limits. It should be appreciated that ranges from any lower limit to any upper limit are contemplated unless otherwise indicated.

As used herein, the terms "up" and "down;" "upper" and "lower;" "upwardly" and "downwardly;" "upstream" and "downstream;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate. The embodiments described herein are equally applicable to horizontal, deviated, vertical, cased, open, and/or other wellbore, but are described with regards to an openhole horizontal wellbore form simplicity and convenience.

Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. An inflow completion assembly, comprising:

a first tubular member disposed within a second tubular member, wherein an annulus is formed therebetween;

a first packer connected to and disposed radially outward of an outer surface of the second tubular member, wherein the first packer comprises a slip;

a first flow port formed through the first tubular member, wherein the first flow port provides fluid communication between an inner diameter of the first tubular member and the first packer, and wherein a portion of the annulus adjacent the first flow port is isolated from other portions of the annulus;

a second packer connected to and disposed radially outward of the outer surface of the second tubular member;

a second flow port formed through the first tubular member, wherein the second flow port provides fluid communication between the inner diameter of the first tubular member and the second packer, and wherein a portion of the annulus adjacent the second flow port is isolated from other portions of the annulus;

an inflow control device disposed between the first packer and the second packer, wherein the inflow control device includes at least one flow restrictor configured to provide a pressure drop to one or more fluids flowing therethrough;

a flow control device disposed at a terminal end of the first tubular member, wherein the flow control device is configured to selectively prevent fluid flow therethrough, and wherein the flow control device is configured to be selectively engaged to build pressure within the inner diameter of the first tubular member;

first and second sealing members disposed between the first and second tubular members to isolate a first portion of the annulus, wherein the first packer and the first flow port are each positioned between the first and second sealing members; and third and fourth sealing members disposed between the first and second tubular members to isolate a second portion of the annulus that is axially offset from the first portion of the annulus, wherein the second packer and the second flow port are each positioned between the third and fourth sealing members.

2. The assembly of claim 1, wherein the first tubular member is releasably secured to the second tubular member, and the inflow control device is connected to the first packer.

3. The assembly of claim 1, further comprising blank pipe disposed between the first packer and the second packer.

4. The assembly of claim 1, further comprising a flow control device disposed within each of the flow ports, and wherein the at least one flow restrictor comprises a nozzle or an aperture having a tortuous flow path formed therethrough.

5. The assembly of claim 1, further comprising a plurality of inflow control devices disposed between the first packer and the second packer, wherein a first inflow control device is connected to a second inflow control device, and the first inflow control device provides a larger pressure drop therethrough than the second inflow control device.

6. A system for controlling the flow of fluid from and into a wellbore comprising:

a conveyance device connected to an inflow completion assembly, the inflow completion assembly comprising:

a first tubular member disposed within a second tubular member, wherein an annulus is formed therebetween;

a first packer connected to and disposed radially outward of an outer surface of the second tubular member, wherein the first packer comprises a slip;

a first flow port formed through the first tubular member, wherein the first flow port provides fluid communication between an inner diameter of the first tubular member and the first packer, and wherein a portion of the annulus adjacent the first flow port is isolated from other portions of the annulus;

a second packer connected to and disposed radially outward of the outer surface of the second tubular member;

a second flow port formed through the first tubular member, wherein the second flow port provides fluid communication between the inner diameter of the first tubular member and the second packer, and wherein a portion of the annulus adjacent the second flow port is isolated from other portions of the annulus;

an inflow control device disposed between the first packer and the second packer, wherein the inflow control device includes at least one flow restrictor configured to provide a pressure drop to one or more fluids flowing therethrough;

a flow control device disposed at a terminal end of the first tubular member, wherein the flow control device is configured to selectively prevent fluid flow therethrough, and wherein the flow control device is configured to be selectively engaged to build pressure within the inner diameter of the first tubular member; and first and second sealing members disposed between the first and second tubular members to isolate a first portion of the annulus, wherein the first packer and the first flow port are each positioned between the first and second sealing members; wherein the first tubular member is releasably connected to the second tubular member, and wherein further the first tubular member is released from the second tubular member by building pressure within the first tubular member.

7. The system of claim 6, further comprising a plurality of inflow control devices disposed between the first packer and the second packer.

8. The system of claim 6, further comprising third and fourth sealing members disposed between the first and second tubular members to isolate a second portion of the annulus that is axially offset from the first portion of the annulus, wherein the second packer and the second flow port are each positioned between the third and fourth sealing members.

9. A method for deploying an inflow control device downhole, the method comprising:

locating an inflow completion assembly within a wellbore, the inflow completion assembly comprising:

a first tubular member disposed within a second tubular member, wherein an annulus is formed therebetween;

a first packer connected to and disposed radially outward of an outer surface of the second tubular member, wherein the first packer comprises a slip;

a first flow port formed through the first tubular member, wherein the first flow port provides fluid communication between an inner diameter of the first tubular member and the first packer, and wherein a portion of the annulus adjacent the first flow port is isolated from other portions of the annulus;

a second packer connected to and disposed radially outward of the outer surface of the second tubular member;

a second flow port formed through the first tubular member, wherein the second flow port provides fluid communication between the inner diameter of the first tubular member and the second packer, and wherein a portion of the annulus adjacent the second flow port is isolated from other portions of the annulus;

an inflow control device disposed between the first packer and the second packer, wherein the inflow control device includes at least one flow restrictor configured to provide a pressure drop to one or more fluids flowing therethrough;

a flow control device disposed at a terminal end of the first tubular member, wherein the flow control device is configured to selectively prevent fluid flow therethrough, and wherein the flow control device is configured to be selectively engaged to build pressure within the inner diameter of the first tubular member; and first and second sealing members disposed between the first and second tubular members to isolate a first portion of the annulus, wherein the first packer and the first flow port are each positioned between the first and second sealing members;

setting the packers;

releasing the first tubular member from the second tubular member; and transferring force generated during the release of the first tubular member from the second tubular member through the first packer to the wellbore, wherein releasing the first tubular member from the second tubular member comprises building a second pressure within the first tubular member, and communicating the second pressure to the annulus between the first tubular member and second tubular member.

10. The method of claim 9, wherein setting the first and second packers comprises building a first pressure within the first tubular member and communicating the first pressure to the first and second packers.

11. The method of claim 9, wherein the flow ports comprise a flow control device disposed therein.

12. The method of claim 11, wherein locating the inflow completion assembly within a wellbore comprises locating the inflow completion adjacent a hydrocarbon bearing zone.

13. The method of claim 12, wherein the inflow completion assembly straddles the wellbore when adjacent the hydrocarbon bearing zone.

14. The method of claim 12, further comprising removing the first tubular member and producing hydrocarbons from the hydrocarbon bearing zone through the second tubular member.

15. The method of claim 14, wherein the inflow control device provides a pressure drop to the produced hydrocarbons as the hydrocarbons flow therethrough into the second tubular member.

16. The method of claim 9, wherein the inflow completion assembly further comprises third and fourth sealing members disposed between the first and second tubular members to isolate a second portion of the annulus that is axially offset from the first portion of the annulus, wherein the second packer and the second flow port are each positioned between the third and fourth sealing members.

* * * * *